United States Patent [19]

Eirich et al.

[11] 4,243,183

[45] Jan. 6, 1981

[54] PREPARATION AND CRUSHING TOOL

[75] Inventors: Wilhelm Eirich, Bahnhofstr. 19; Gustav Eirich, Walldürnerstr. 41, both of Hardheim, Fed. Rep. of Germany

[73] Assignees: Wilhelm Eirich; Gustav Eirich, both of Hardheim, Fed. Rep. of Germany

[21] Appl. No.: 1,322

[22] Filed: Jan. 4, 1979

[30] Foreign Application Priority Data

Feb. 15, 1978 [DE] Fed. Rep. of Germany ..... 2806315

[51] Int. Cl.[3] ..... B02C 13/02

[52] U.S. Cl. ..... 241/186.2; 241/186 R

[58] Field of Search ..... 241/187, 228, 229, 171, 241/180, 186.2, 186 R

[56] References Cited

U.S. PATENT DOCUMENTS

| | | | |
|---|---|---|---|
| 1,607,404 | 11/1926 | Low | 241/228 X |
| 2,056,583 | 10/1936 | Moussette, Sr. | 241/180 X |
| 2,108,160 | 2/1938 | Beaudry | 241/187 X |
| 2,108,793 | 2/1938 | Borton | 241/187 X |
| 2,592,334 | 4/1952 | Reiffen | 241/222 X |
| 3,498,547 | 3/1970 | Kern | 241/138 X |
| 3,545,685 | 12/1970 | Adams | 241/228 X |
| 3,931,937 | 1/1976 | Hahn | 241/187 X |

FOREIGN PATENT DOCUMENTS

| | | | |
|---|---|---|---|
| 1944339 | 9/1971 | Fed. Rep. of Germany . | |
| 2161030 | 9/1971 | Fed. Rep. of Germany | 241/187 |

*Primary Examiner*—Richard B. Lazarus

*Attorney, Agent, or Firm*—Biebel, French & Nauman

[57] ABSTRACT

A preparation and crushing tool, particularly for processing refuse material, including a drum mounted for rotation about a central axis at a subcritical speed, at least one rotor disposed within the drum eccentric to the axis of the drum and mounted for rotation about its own axis in a direction opposite to the direction of rotation of the drum and at a higher speed than the drum. The rotor includes a plurality of splitting tools which are disposed in axially and radially spaced locations along the axis of the rotor. A stationary hood is provided which forms an end wall of the drum and is in sealing engagement therewith. Material is fed into the device in the upper region and provision is made for discharge of the processed material from the lower portion of the device.

17 Claims, 29 Drawing Figures

Fig.20B
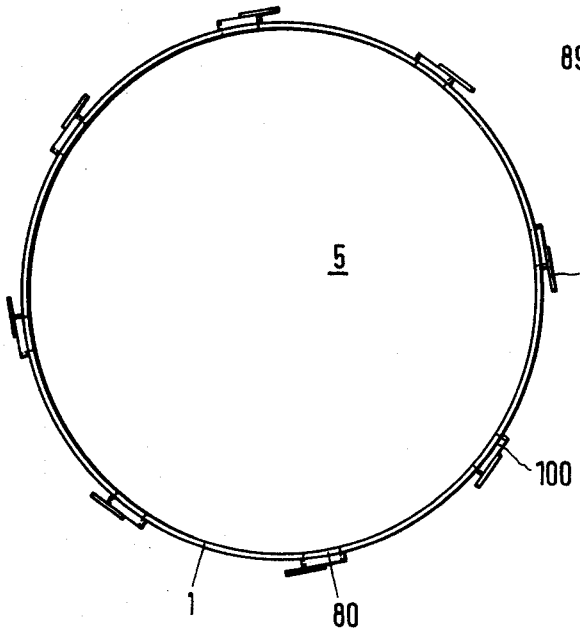
Fig.20A
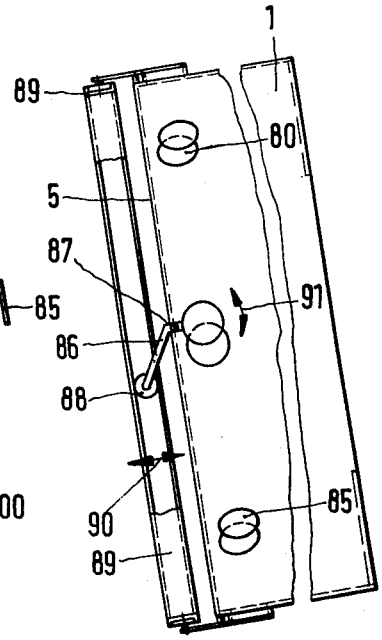
Fig.19B
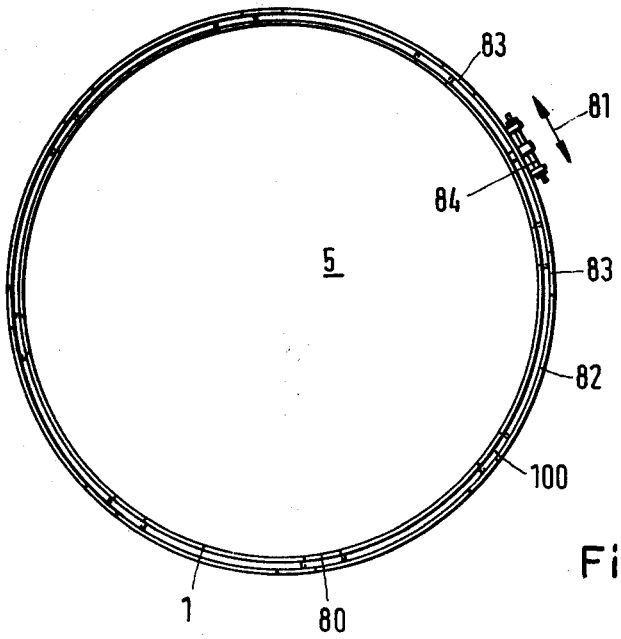
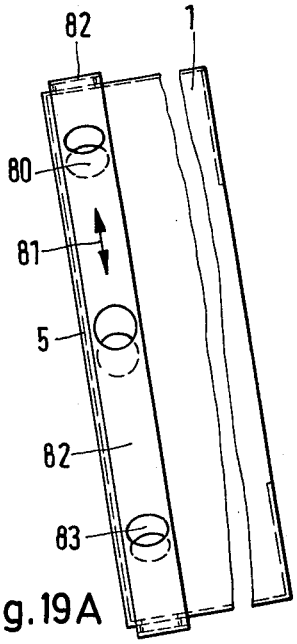
Fig.19A

Fig.21B
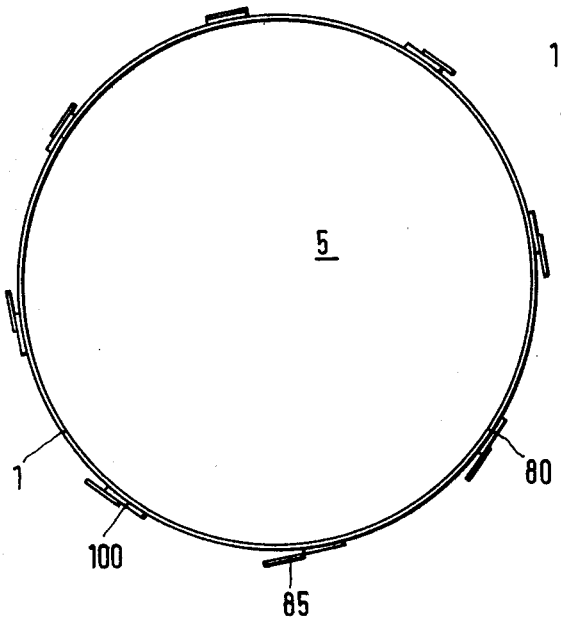
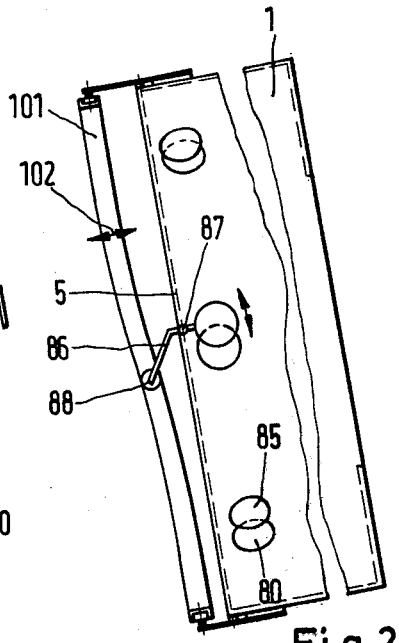
Fig.21A
Fig.22B
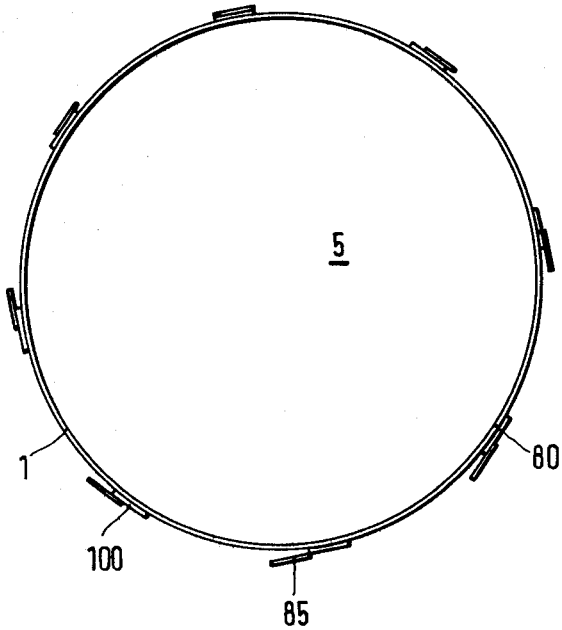
Fig.22A
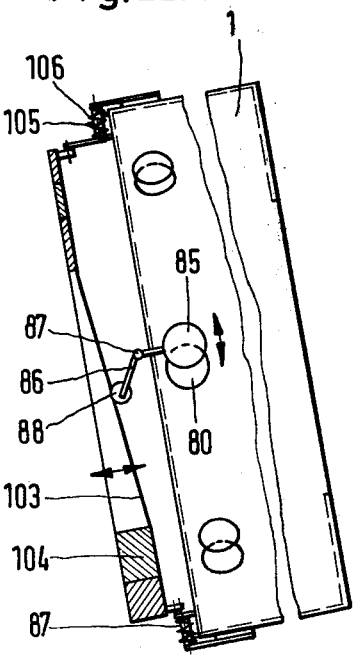

PREPARATION AND CRUSHING TOOL

BACKGROUND OF THE INVENTION

The invention relates to a preparation and crushing device, particularly for refuse materials, having a rotatably driven drum and at least one eccentricly disposed high-speed rotor, which rotates in the direction opposite to the direction of rotation of the drum.

The invention described below is described chiefly in connection with refuse materials, e.g. garbage, but can of course also be used for many other materials, examples of some being given below.

It is known that the increasing quantities of refuse produced by cities, parishes and industry, necessitate the manufacture of large refuse disposal plants. In this connection, the problem of preparation and crushing occurs at numerous stages of the process. This is also true with regard to the utilisation of raw material stocks in world trade and industry or of residue produced during manufacturing. Thus, a preparation and crushing device is sought which is able to process continuously or discontinuously and in large quantities materials of very varying compositions. The process is concerned primarily with crushing, mixing and sorting or sieving, these being activities which are required to be carried out either consecutively or simultaneously.

A crushing device, which has the features of the kind described at the outset, is already known for processing garbage and refuse material. The high speed rotor used therein is provided with at least one toothed, disc, the plane of which extends at right angles to the rotor shaft and partially submerges into the material held against the container wall by means of the over-critical rotational speed. This known crushing device may already be used in a wide range of applications, such as the processing of refuse even supplied in refuse sacks, of boxes and of materials in bundles. The known device functions according to the principle that the materials to be processed, particularly in the case of fine crushing, are held firmly against the interior wall of the container by virtue of the rotating container being driven at an over-critical speed and are crushed by means of a toothed circular disc. The critical rotational speed represents that number of revolutions per minute for the drive of the drum at which the centrifugal force is greater than the weight of the material being processed, so that the material is pressed against the interior wall of the drum.

However, the inhomogenity of the material, particularly with regard to refuse materials, presents difficulties under certain circumstances which lead to problems even in the case of the crushing device described above. It has, for example, been shown that an extremely uneven feeding results in high load peaks of the rotor drive so that the known device functions at times with an excessively high energy consumption. These load and energy peaks occur in particular in the case of correspondingly unsuitable material to be processed due to the fact that the distance between the rotor and the interior wall of the drum is purposely kept small therein.

The over-critical rotational speed of the known drum requires the inner surface of the drum to be smooth of course. It has been shown in the case of wet, slippery material that under certain circumstances this material slides past the interior wall of the drum and leads to blockages. The reason for this is the lack of friction between the drum wall and the material to be processed. On the other hand it is not possible to attach entrainment members to the interior wall because they would collide with wall strippers which are required to detach the layer of material from the drum walling and cause sifting and circulation.

Particularly coarse-grained material can lead to damage to the known crushing device due to the fact that lumps of metal enter the area between the rotor and the inner wall of the drum and cause damage on the zones of contact. For this reason it has been found necessary to incorporate a pre-crushing means and to provide a magnetic cut-out.

The problem of the invention is therefore, to provide a preparation and crushing device of the kind described at the outset, which, while avoiding load peaks and the need for additional machinery, permits material which may be voluminous, lumpy, coarse and hard to be processed, prepared, mixed and crushed using simple tools; if necessary, right up to the fine-fibred or flour-like dressing of the particles.

SUMMARY OF THE INVENTION

A solution to this problem is provided in accordance with the invention in that the drum is driven at a subcritical rotational speed and with a stationary covering hood, in which a feed means is disposed, that a discharge opening, preferably in the lower region of the device, is provided and that a plurality of splitting tools are mounted at intervals on the rotor along its pivot axis.

In the majority of preferred embodiments, the feed means is disposed in the upper part of the covering hood. In the new device according to the invention, the material to be processed is brought up to the processing tools certainly and evenly so that a secure grip is always ensured. The apparatus according to the invention is surprisingly insensitive to the feeding of varying materials in colourful succession in one operating cycle, e.g. filled sacks followed by compressed bales, empty crates and liquid as well as plastics components. Further suitable fields of application include the preparation, crushing, drying and cooling of combined moulding sands, the drying of silage and similar materials, the separation and recovery of plastics from refuse, the reprocessing and utilisation of refuse from livestock breeding and refuse materials from the metal processing industry, e.g. the preparation of lumpy masses of metal drillings which are produced. The function of the device according to the invention could be described by the words "impact tearing", since the breaking limit of the material being processed is loaded using impact and tough materials are torn. The many-sidedness of application is considerably increased over the known devices by the steps of the invention. The material being processed is no longer held against the inner wall of the drum by an over-critical rotational speed but is purposely designed to fall down onto the crushing rotor from a previously selected apex after being carried upwards.

A stationary covering hood prevents the emergence of dust and air pollution, protects the surroundings from parts which may possibly be spun out of the processing area of the device and permits the pivot axis of the drum to be disposed substantially horizontal, this being preferred in some embodiments of the invention. Good circulation of the material being processed is then ensured and the tumbling down of all material parts one after another is made certain. The fixed covering hood readily permits the incorporation of a feed means, which is preferably provided in the upper part of the covering hood and is of large dimensions, in order that lumpy materials, e.g. refuse sacks can also be fed in. The general construction of the device according to the invention is particularly simplified in that the discharge opening can be disposed in the fixed covering hood. Thus, special means for regulating the size of the material to be crushed can be easily provided at the discharge opening; as will be described below. The rotor of the device according to the invention has a large operating region both in the peripheral direction of the rotating drum through the circulating material to be processed and in the direction of the drum depth in that it has a plurality of splitting tools along its pivot axis. Among these preferred tools are cutting or striking tools, e.g. radially disposed bars, teeth, impact plates or other, if necessary, metal-clad striking tools, which load the material being processed with impact and tearing.

It is also expedient according to the invention if the outer periphery of the splitting tools of the rotor is disposed at a considerable distance from the inner wall of the drum. This embodiment of the device according to the invention avoids the disadvantageous jamming effect described above in conjunction with the state of the art, so that there is less need to fear damage but the preparation nevertheless takes place in a surprisingly thorough manner. The aforementioned distance is particularly advantageous when two rotors are incorporated since it enables such a large material flow to rise between the container wall and the first rotor in order that the second rotor can be acted upon sufficiently strongly.

The invention is also advantageously constructed in that the pivot axis of the rotor is disposed in the vicinity of the horizontal bisector of the floor of the drum. Particularly in the case of plate pivot axes extending substantially horizontally the splitting tools are free when the material being processed is resting, but is located chiefly in the lower half or the lower third of the drum.

If, for example, there is a power cut or the machine is stopped for any other reason when loaded normally, then the rotor can start up again immediately the machine is switched on because its tools stand free beyond the material being processed.

It is also advantageous according to the invention if entrainment means are distributed over the interior wall of the drum. This step, which is impossible in the case of a drum rotating at an over-critical speed, enables the material to be guided upwards reliably to the desired apex, from which the material tumbles down and streams directly into the rotor in the manner of a water fall. The action of these entrainment means is particularly intensive if they are staggered vertically in relation to one another in accordance with the invention.

In a further preferred embodiment of the invention, the entrainment means are cam or tooth shaped without acute angles. By avoiding acute angles fibres or fibre particles of the material are prevented from adhering. The cams or teeth ensure however, advantageously, the excellent crushing of textiles, foils, waste paper, wood, etc., because considerable cutting and shearing forces can be exerted on the material which is, as it were, braced by these entrainment means. If the walling of the drum were smooth the material could yield very easily so that the splitting tools of the rotor would not encounter sufficient resistance.

An expedient construction of the entrainment means is characterised in that the entrainment means are provided in the form of parallel rings spaced apart from one another. Thus there is provided a form of internally toothed rings, which are distributed vertically over the drum and parallel to the plate floor and attached to the inner walling of the drum. The splitting tools of the rotor are then expediently so disposed that they engage respectively in the space between two rings. Thus, particularly during the crushing of fibrous material, the cutting and shearing activity described above is benefited.

In another embodiment of the invention it is expedient if the wall of the drum is in the shape of a truncated cone. In this way, even in the case of relatively small drums, a large feed means is obtained or a large covering hood, which permits the mounting of a large feed means. Then, lumpy materials may also be processed. The conical shape of the drum wall enables the floor of the drum to be advantageously inclined relatively flatly, i.e. in the horizontal, and thus the period of duration of the material is extended.

The discharge ratios are also improved by the truncated-cone shaped drum. In certain fields of application the cone-shaped drum walling may be specially provided.

Such an embodiment is expediently characterised in accordance with the invention in that the casing surrounding the splitting tools of the rotor is a truncated cone. While in the case of normal rotors, whose outer shape is substantially cylindrical and whose pivot axis should be disposed at an angle to the pivot axis of the drum when the plate is in the shape of a truncated cone, in order that the rotors sweep as comprehensively as possible over the working surface, on which the material lies, the last-mentioned feature of the rotor enables its axis to be disposed parallel to the pivot axis of the drum. The diameters of the individual splitting tools disposed on the rotor or designed in the shape of a disc are graduated in such a way that the tools are positioned over the entire drum inner wall at the same distance from this wall. At the higher peripheral speed of the drum and the rotor in the region of the discharge it is even possible for a very thorough fine-crushing to be carried out once more in this region. At the same time a large part of the crushing energy and with it is the largest part of the forces would then become active in the upper region of the rotor shaft so that the shaft bearing would advantageously be subjected to a reduced load.

In an expedient further embodiment of the invention a straining wall is disposed at a distance from the drum wall. This step is beneficial in the processing, particularly crushing, of materials of straining consistency. According to this feature, no discharge opening is then provided in the device according to the invention. The entire crushing material, which has achieved the desired fineness, emerges through the straining opening in the straining wall. A stationary hood, which represents both protection against contact and collecting vessel for the fine crushed material, is laid around the rotating container, in this special case the crushing container for example. In the lower region this hood is preferably drawn together to form a funnel so that the fine material converging there can be delivered to a conveying means.

A further preferred embodiment of the invention is characterised in that the discharge opening is in the form of a discharge flap pivotally mounted on the covering hood and pre-stressed in the closing direction, which is inclined in the direction of the flow of the material. The emptying of the device according to the invention can be adjusted very accurately and provided with the means and features described without too great an effort. If the crushing device is processing household refuse and similar materials, for example, then it is important that any pieces of textiles, foil, etc., present in the crushing material does not adhere to the corners and gaps beside and at the discharge opening and lead to blockages there. Discharge openings constructed according to the foregoing features ensure trouble-free operation. The inclined position of the discharge flap enables the material flow to be guided from the covering hood into the interior space of the plate so that the dangerous strand-like materials do not adhere and lead to blockages. The discharge flap preferably does not reach quite to the upper rim of the rotating drum so that sufficient crushed materials can be continuously discharged as required. The pre-stressing of the discharge flap in the closing direction permits the regulation of the pressure, with which the flap acts in opposition to the crushed materials gushing out.

The flow characteristics of the material to be treated are, furthermore, advantageously influenced if, in accordance with the invention, deflectors and/or guiding blades are provided in the region of the discharge flap. The circulation of the material in the device of the invention leads, as a rule, to a certain automatic sorting, whereby the finer material comes to rest in the lower region of the layer of grinding material and the coarser material comes to rest in the upper region of the layer of grinding material.

This sorting effect causes mainly fine material to be discharged at the lower region of the discharge flap. The deflectors and/or guiding blades, which, of course, are mounted on the inner side in the region of the discharge flap, and the guiding blades, which are mounted preferably directly at the flap, held to deflect upwardly coarser material, which is not yet required to be discharged, and return it for reprocessing.

It has further been shown to be advantageous if entrainment means are mounted according to the invention on the inner wall ofthe drum and inclined to the pivot axis of the drum. The entrainment means convey the material to be processed from the lower region of the drum at its floor upwardly to the drum rim or inwardly towards the processing tools in the manner of a segmentally disposed screw depending upon their number and the angle at which they are positioned.

It is further expedient if a plurality of closeable discharge openings are provided in the drum wall in the vicinity of the plate floor. The discharge device preferably disposed in the lower region may then be omitted because it is replaced by the discharge opening. If dry, granular material, such as rock chippings, for example, is processed with the device according to the invention, it has been shown that the coarser grain frequently rolls against the discharge opening while the fine-grained material collects in large quantities at the lowest point in the bottom of the drum. If the device according to the invention is used as a crushing machine, then the fine-grained material is of principle interest and devices must be provided which effect discharge. This takes place in a surprisingly advantageous manner by means of the discharging openings. These may be in the form of slots, round, oval or have any other shape.

The number of openings is dependent upon the size of the device and the output capacity required. It has been shown that two, three or four discharge openings distributed over the drum periphery are preferred.

For the processing of dry and wet, non-fibrous materials, the possibility also exists of incorporating screening plates in the side wall of the drums so that sufficient crushed material passes outwards through the screens. A stationary collecting casing is provided in this case for collecting the fine-grained material.

In an advantageous further embodiment of the invention, the discharge openings can be closed by means of a ring with corresponding openings which is displaceable in the peripheral direction, or by means of a cover mounted on double-armed levers, wherein the end of the double-armed lever lying opposite the cover is provided with a roller secured to a guide rail. In the one embodiment, the drum has the same openings as the displaceable ring. Depending upon the degree of displacement of the ring the entire cross-section of the opening or part of the cross-section can be freed. In this way, the discharge quantity can be regulated. The discharge itself only takes place in the lower region of the drum. Thus, the sorting effect of the rotating drum is immediately used.

Another embodiment of the invention is characterised in that the guide rail is designed as a fixed curve template, preferably composed of replaceable pieces, against which the roller on the double-armed lever is pre-stressed for abutment. In this case each opening has a pivotable end plate, which frees the opening cross-section of the discharge openings completely or partially. If the guide rail or curve template is displaced at a distance to the drum floor the position of the end plate also alters. In a particular embodiment of the invention the arm carrying the drum is mounted on the outer surface of the plate floor in a guide tube or sleeve. A torsion spring is disposed in this sleeve and holds the plate in the closed position. The roller described above is provided on the second arm of the lever and rolls over the curved template in the opening and closing zone. This promotes the opening and closing movement. If the distance of the curved template to the drum floor is altered, the pivot movement of the lever alters simultaneously. In this way, the discharge cross-section can be completely or only partially freed. As soon as the plates have passed through the discharge zone, the openings are closed and remain closed. Adjustment can be made manually or automatically during operation, if necessary in dependence on the load of the drive means. The described arrangement of the movement mechanism offers the advantage that the curved template can be disposed not on the periphery of the drum but also in the vicinity of the plate axis. The peripheral speeds are lower at this point and a shorter curve template can be used. The distance between the outer periphery, at which the plates are disposed, and the curve template disposed further inwards is bridged by the aforementioned sleeves or the guide tube, which is also indicated below as a pivot axis in conjunction with the drawings. By altering the length of the curve template the opening time can also be varied. Intermediate pieces may also be inserted or removed and the duration of opening of the discharge openings thereby varied.

It is further expedient according to the invention if both rotors are driven in opposing directions and are disposed in that half of the drum having an upward direction of flow. For it has been shown that particularly during the processing of heavy materials there is a tendency for large pieces of material not to be carried out over the centre of the drum (vertical, central plane through the pivot axis between upward and downward material flow), even at a higher rotational speed of the drum, but for the material to tumble down almost vertically just before reaching the apex. If the two rotors are then arranged in the manner described above, there is the surprising advantage that a substantially larger surface for the feed opening, e.g. for lumpy material, is made available on the half of the drum extending downwards with the descending material and in addition the crushing action of both rotors can be suddenly increased, particularly if the lower rotor rotates in a direction opposite to the direction of rotation of the upper rotor but in the same direction as the direction of rotation of the drums.

It is further advantageous in accordance with the invention if small steel balls of the size of agitating balls are provided in the drum and can be accelerated by the rotors by means of centrifugal tools in order to increase the impact effects. The device according to the invention then functions with crushing balls in a manner similar to a ball mill. If the splitting tools of the rotors are appropriately constructed they can be used as centrifugal tools. Otherwise, other throwing tools of highly wear-resistant material, e.g. rubber or the like can be used. The centrifugal rotor is driven and acted upon by a mixture of balls and material to be treated. Strong impact, pressing and circulating forces become active immediately upon impingement. The same applies when the mixture of balls and material is spun off the rotor. The resultant trajectory stream is projected into the thick layer of rising material, whereby the energy contained in the stream is transformed into impact, pressing and friction action and results in an intensive grinding or crushing action. The acceleration imparted to the mixture of balls and material can, in contrast to normal ball mills, be selected as high as required. The upper limit is defined by the strength of the ball material. The high acceleration permits the use of small grinding balls, whose points of contact and impact—with respect to the ball weight are many times higher than in the case of balls having a larger diameter and greater net weights, such as are required in order to achieve sufficient impact effects during lower ball movement.

In grinding technology the good effect of so-called agitating balls is known. However, their field of application is substantially restricted to liquid grinding material, while the embodiment according to the invention is also suitable for dry and wet grinding material and can be constructed to any desirable dimension. In order to pass through a device according to the invention, the basic material can also be fed into the device as a substantially coarser grained material than in the case of agitator ball mills. It is further possible to provide the container and rotor with a higher wear-resistant rubber covering and to use grinding balls made of porcelain or another non-metallic hard material, if the material to be processed must remain iron-free.

BRIEF DESCRIPTION OF THE DRAWINGS

Further advantages, features and possible uses of the present invention are set forth in the following description, in conjunction with the drawings wherein:

FIG. 19*a* is a lateral view of a diagrammaically illustrated drum with closable discharge openings.

FIG. 19*b* is a plan view of the drum from its floor side.

FIGS. 20*a* and 20*b* are similar illustrations to that of FIG. 19, however, of another embodiment.

FIGS. 21*a*, 21*b*, 22*a*, 22*b*, are illustrations showing the same views as FIGS. 19*a* and 19*b*, showing two different closing devices, however, for the discharge openings.

FIG. 25 shows a diagrammatic front view of another device according to the invention with two rotors, however, according to another embodiment, wherein both rotors are disposed in that half of the drum in which the material ascends, and rotate in opposite directions with regard to one another and, FIGS. 24*a* and 24*b* are a lateral view and a plan view of a drum having entrainment means disposed on the inside of the periphery and inclined towards the pivot axis of the drum.

DETAILED DESCRIPTION OF THE PREFERRED EMBODIMENTS

Figure 1:
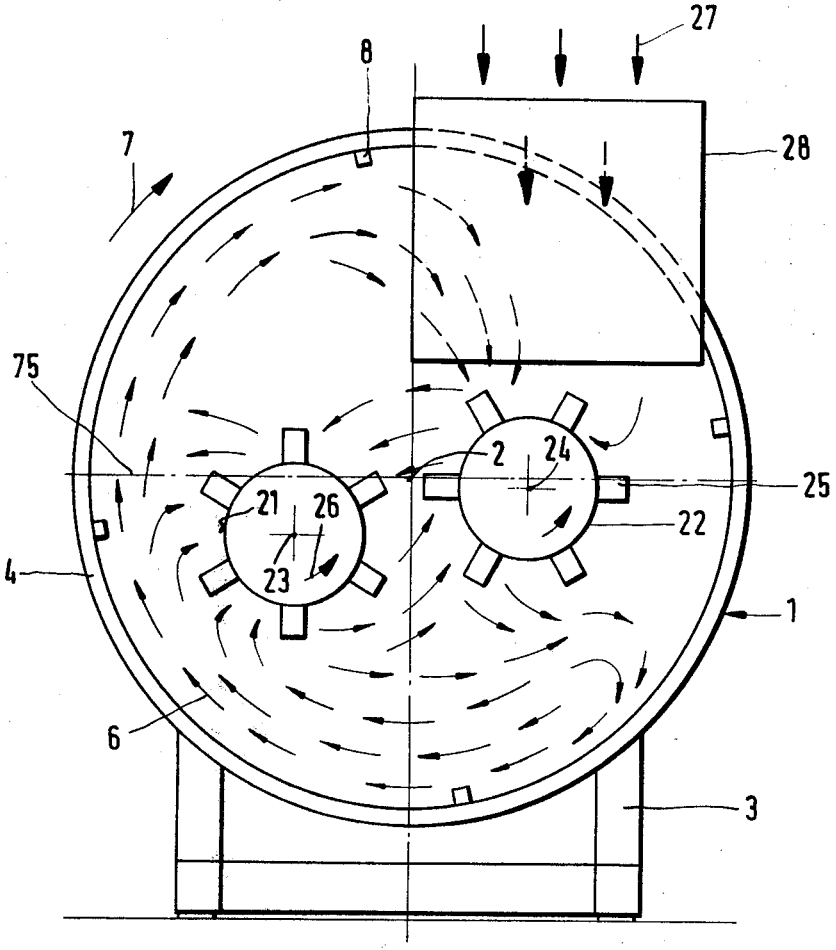
FIG. 1 is a front view in diagrammatic form of a device according to the invention with two rotors, looking down onto the drum from above with the covering hood having been removed.

The preparation and crushing device illustrated in FIG. 1 has a pivotably driven drum 1 with a pivot axis 2 and a bearing (not illustrated), located on the diagrammatically indicated frame 3. The drum referred to generally by reference symbol 1 has a wall 4 and a floor 5, the stream of grinding material 6 being illustrated by the numerous arrows. When the drum 1 rotates in the direction of arrow 7 this stream is carried upwards by means of the entrainment means 8 in a clockwise direction and engages with the two rotors 21, 22, which rotate about their pivot axes 23 and 24. The rotors 21 and 22 have splitting tools 25. In the illustrated embodiment these are in the form of radially disposed bars. The rotors 21 and 22 rotate in the direction of the arrows 26, in other words in opposition to the direction of rotation of the drum 1. The five heavily printed arrows 27 illustrate the stream of material to be treated which has been fed through the feed means 28 into the machine.

During operation the material 27 first falls through the feed means 28 to the rotor 22 disposed on the right hand side, whose pivot axis 24 is higher than the pivot axis 23 of the left-hand rotor 21. The material seized by this rotor 22 is for the most part spun onto the rotor 21 with considerable pre-acceleration and is seized there by the splitting tools 25 with increased impact and tearing force. The speeds combine here so that good crushing forces become active. The rotor 22 spins the material into the layer of grinding material ascending the drum wall 4, whereby further autogenous grinding takes place.

The material transported upwards from the drum 1 is seized in the inner-lying layer by the left-hand rotor 21 in the contrarotating direction and is crushed. The layer lying against the drum wall 4 is, in contrast, carried upwards and plunges approximately at the uppermost point of the drum 1 in the manner of a waterfall back into the operating region of the two rotors 21 and 22. The trajectory parabola of the descending material can be controlled by the peripheral speed of the drum 1 in such a way that the material descends principally onto rotor 21 or principally onto rotor 22 or evenly distributed onto both rotors.

Figure 4:
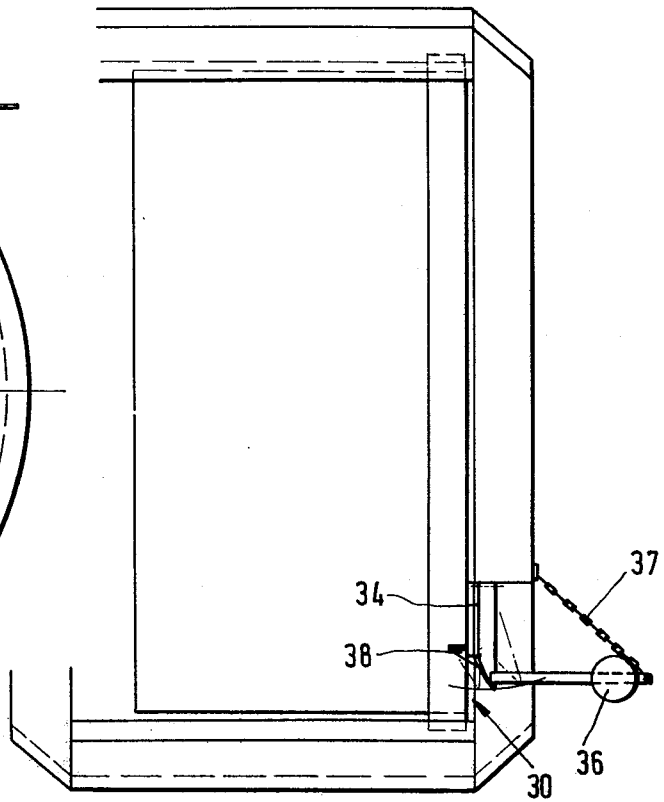
FIG. 4 is a lateral view broken away and in diagrammatic form looking from left to right at the illustration of FIG. 2.
Figure 2:
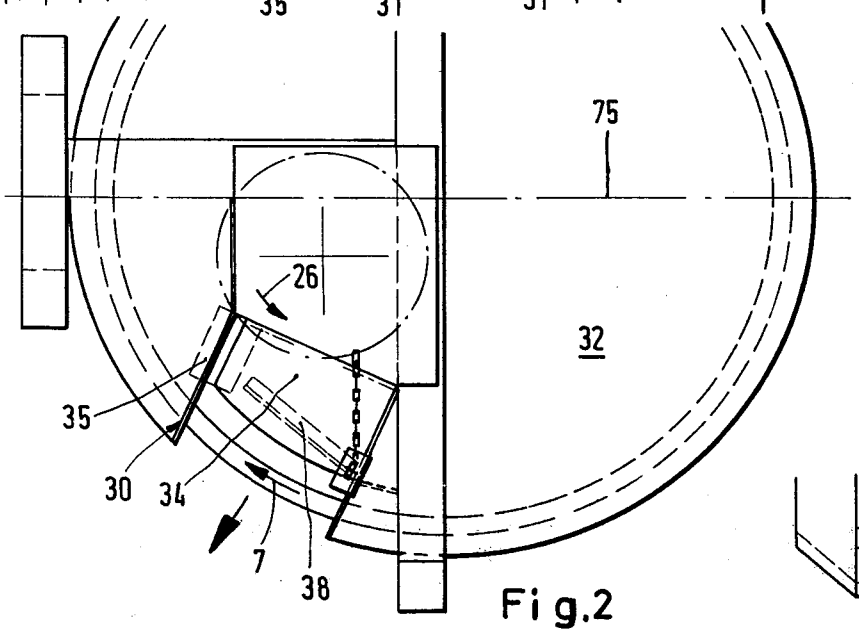
FIG. 2 is a plan view broken away and in diagrammatic form of the covering hood with discharge opening.
Figure 3:
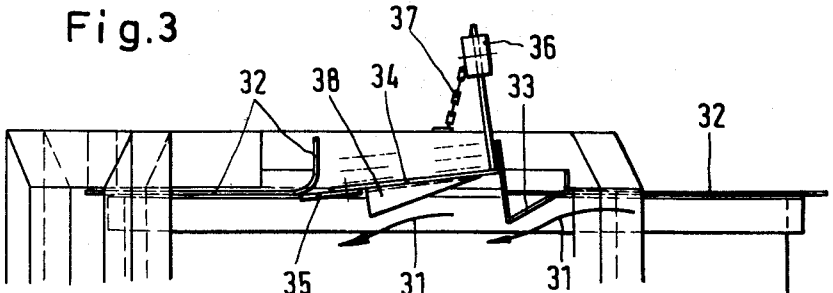
FIG. 3 is a lateral view broken away looking from beneath onto the the illustration of FIG. 2.

FIG. 2 is a plan view and FIGS. 3 and 4 are the above-mentioned sectional views of the discharge opening of the device of the invention, generally referred to by reference symbol 30. The grinding material flows in the direction of arrows 31 along the covering hood 32 down towards the discharge opening. At the end of the covering hood a wedge-shaped deflector 33 leads approximately in the direction of the interior of the drum 1 so that in principle the material passes over the gap between the discharge opening 30 and fixed covering hood 32 without contact. The discharge flap 34 does not quite reach to the plate rim, which can be seen in FIG. 2 in the region of the arrow 7, because the entrainment means 8 must have a passage beneath the discharge flap 34. The discharge flap 34 itself is inclined in the flow direction of the material, as can be seen particularly in FIG. 3, so that the gap between the covering hood 32 and the discharge flap 34 on the side, on which the material arrives, is displaced outwardly away from the material. On its exit side the discharge flap 34 is extended by means of a flexible member, e.g. of plastics or rubber, 35 to such an extent that it overlaps with the adjoining fixed covering hood 32. The gap is completely covered by this flexible member 35 so that no material can adhere there. At the same time the discharge flap 34 can, however, be folded out upwards in order to increase the width of the opening. A loading weight 36 serves to regulate the positioning of the flap as well as a hauling chain 37. A guide blade 38 is also mounted on the discharge flap 34, with the aid of which the coarse-grained particles of the material are deflected upwards into the drum.

Figure 5:
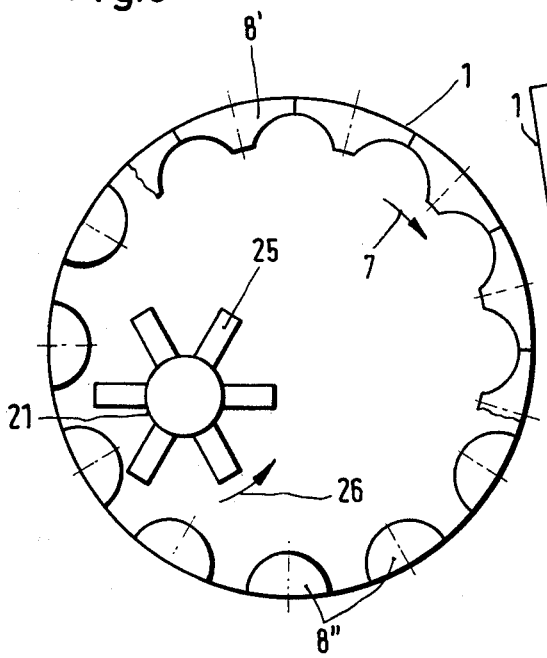
FIGS. 5 to 8 are diagrammatic plan views or sections of the cylindrical drum, the entrainment means being disposed in the manner of a ring in various embodiments.
Figure 6:
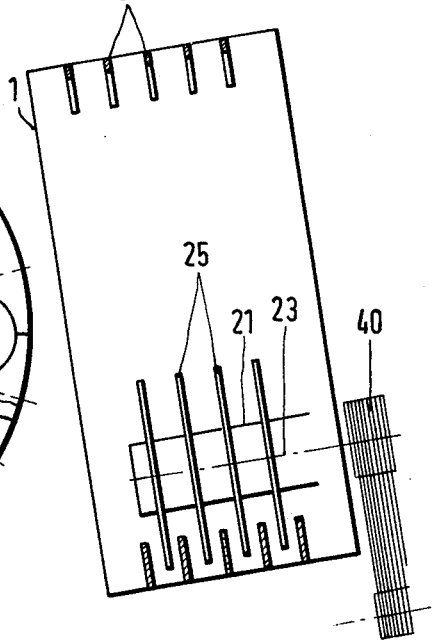

In FIGS. 5 and 6 the drum 1 is only illustrated in rough diagrammatic form with its direction of rotation 7. The one rotor 21, which rotates in the direction of arrow 26, has four splitting tools 25 here in the direction of its pivot 23 and is driven by way of wedge belts 40 illustrated diagrammatically. The entrainment means are constructed here in the upper half in the form of teeth 8' and in the lower half in the form of cams 8''.

Figure 7:
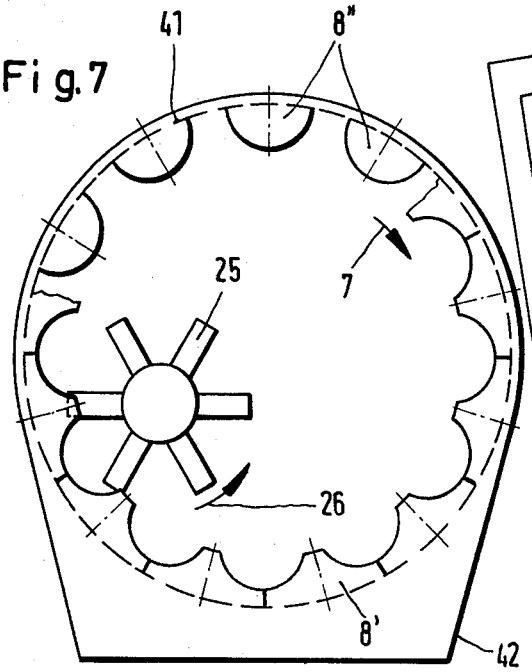
Figure 8:
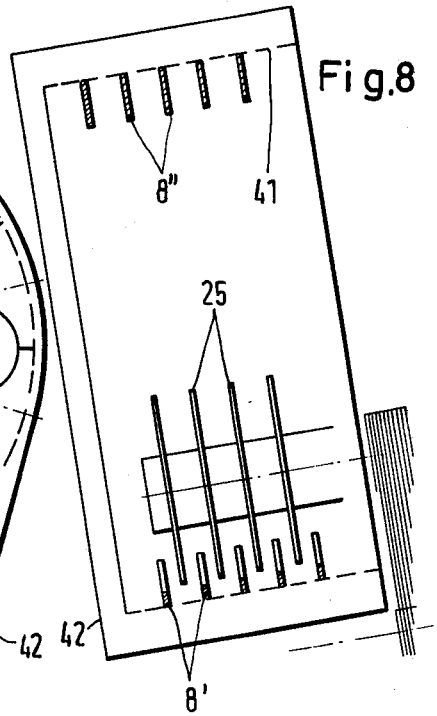

They are—just as in the illustration in FIGS. 7 and 8—spaced vertically apart from one another and provided parallel to one another in the form of rings. The material is thereby secured on the drum wall in the best way, braced in as it were, so that it can be divided up by the splitting tools 25. The splitting tools 25 of the respective rotor 21 engage between these annular teeth 8' and cam 8'' so that the material is supported on these cams and teeth and the splitting tools 25 can be offered sufficient resistance.

In addition, in the embodiment according to FIGS. 7 and 8 a cylindrical straining wall 41 is also provided, being mounted at a distance from the wall of the drum 1 on the inside of said plate. No discharge opening is provided in this embodiment. The material which is broken up or crushed after processing and has attained the desired fineness passes out downwardly through the openings in the straining wall 41. It is collected in a hood 42 enclosing the straining container 41, which hood is designed in its lower region as a funnel. Conveying means not illustrated convey out the fine ground material which has collected here. Naturally, the machine according to the embodiment of FIGS. 7 and 8 may also be constructed without the teeth 8' or cams 8'' disposed in the shape of a ring.

Advantageously, the straining wall 41 can also be used for drying and/or cooling the material. In this connection the cooling or heating gases are supplied in the inner region of the drum 1. Suction is effected by way of the fixed casing or hood 42 so that the gases are passed transversely through the material and the straining wall 41. This method makes available a particularly large surface for thermal exchange.

Figure 9:
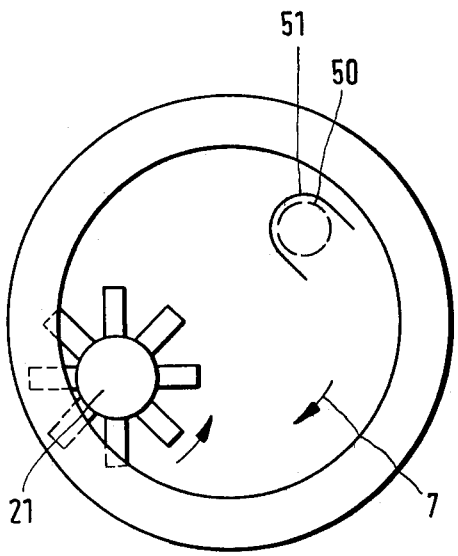
FIGS. 9 and 10 are a diagrammatic plan view and cross section of a particular embodiment with a suction tube for the pneumatic removal of moist or light material to be treated.
Figure 10:
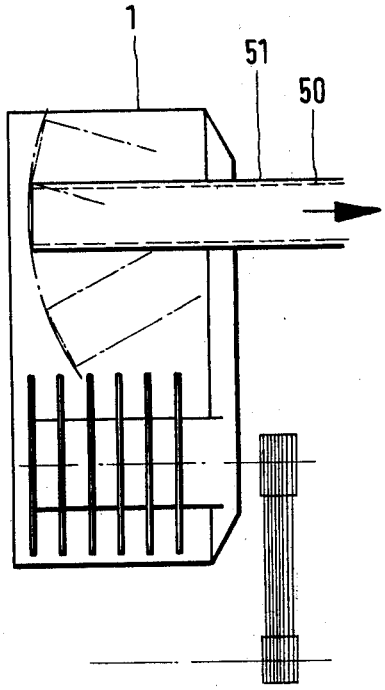

In the case of very fine or light grinding materials the removal of the material from the crushing device according to the invention may also be effected pneumatically. This embodiment is illustrated in FIGS. 9 and 10. Here, a tube 50 connected to a suction fan not illustrated projects into the drum 1 and sucks up the fine or light material particles there. In this way it is possible to separate by suction foils, for example, or paper from household refuse or similar materials or to suck up very fine materials according to the air sifting principle. The tube acting as a suction nozzle may be of open, slotted, apertured or a similar construction. A bent plate 51 protects the tube 50 on the side of arrival of the stream of material. The intake opening is thus situated on the opposite side so that only material which can be transported with air finds its way to the suction nozzle 50 and thus the desired selection takes place. The tube 50 may be pivotally mounted, as shown in FIG. 10 by the dash-dotted lines. In order to empty the drum 1 completely the tube 50 can be pivoted right down to the rim of the floor.

Figure 11:
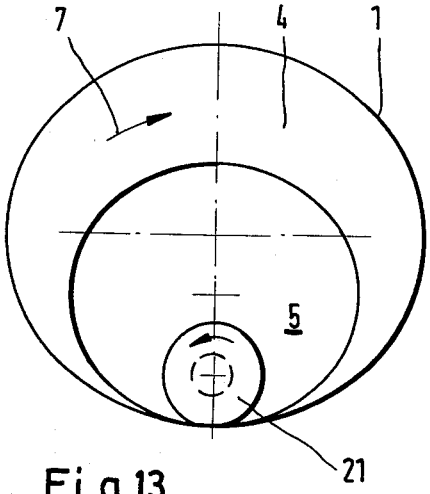
FIGS. 11 to 16 show various embodiments with conical or truncated cone shaped drums.
Figure 12:
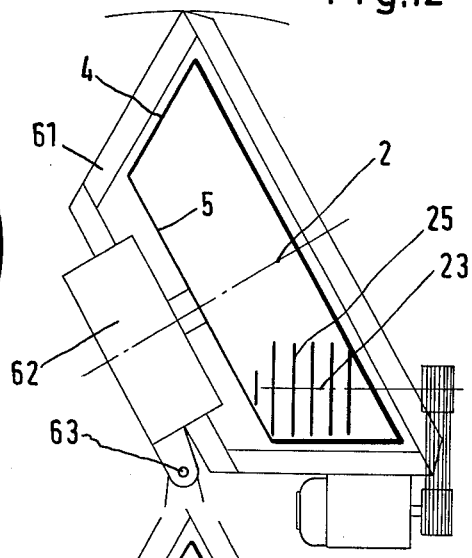

FIGS. 11 and 12 are plan views in diagrammatic form of another embodiment of the device according to the invention, wherein the wall 4 of the drum 1 is in the shape of a truncated cone. It is possible by means of a conical drum to feed lumpy material into small machines as well because a large intake opening can be provided by virtue of the profiling. In addition, the floor 5 can be brought into the position illustrated in FIGS. 12, 14 and 15 by pivoting the frame 61 with the bearing 62 about the pivot point 63, in which position the floor 5 is inclined relatively flatly, i.e. the pivot axis 2 of the drum 1 is at a considerable angle to the horizontal. In this way, the filling or duration of the stay can be increased during processing. The rotor 21, which is only shown diagrammatically with the splitting tools 25 here, lies with its shaft 23 parallel to the lower side wall 4 of the drum 1.

Figure 13:
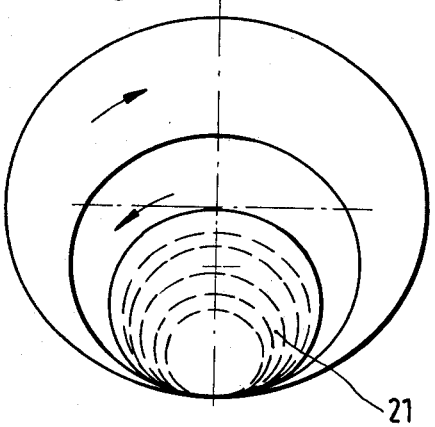
Figure 14:
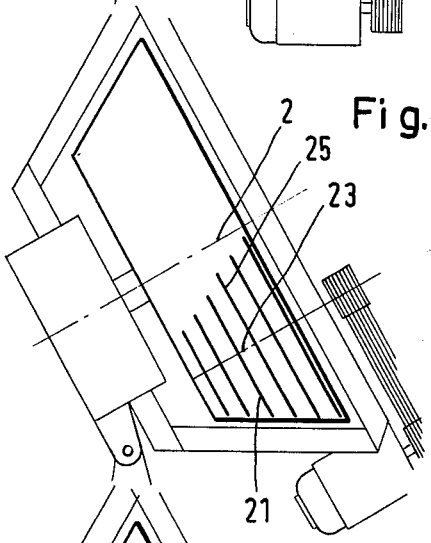

In the embodiment according to FIGS. 13 and 14, wherein a conical drum 1 is also provided and a similar inclination is also possible, the shaft 23 of the rotor 21 is vertical to the floor 5 of the drum 1 and the diameter of the splitting tools 25 is graduated respectively so that the tools are at the same distance from the wall over the entire lower side wall of the drum 1. It has already been mentioned above that another thorough fine crushing can take place here in the region of the discharge. Also, the bearing of the shaft 23 of the rotor 21 is subjected to less load.

Figure 15:
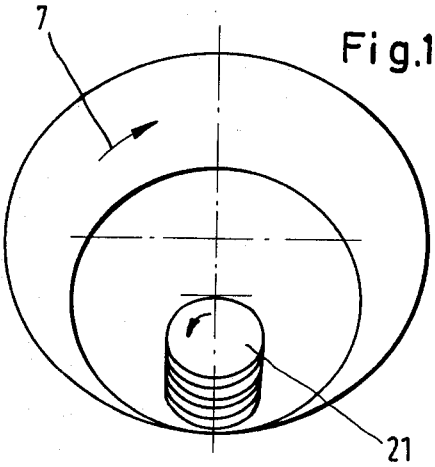
Figure 16:
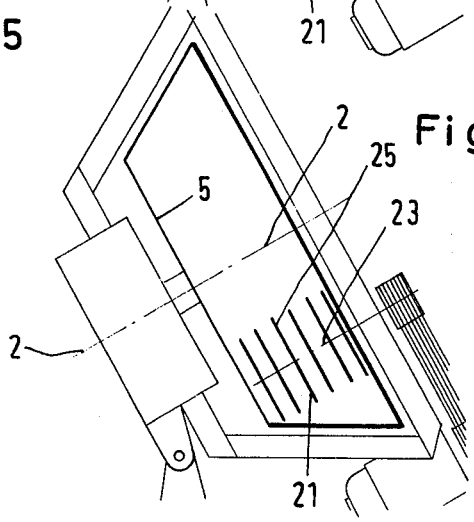

In the embodiment according to FIGS. 15 and 16 the shaft 23 of the rotor 21 is again vertical to the floor 5 of the drum 1 or parallel to the pivot axis 2 of the drum. However, the splitting tools 25 here have the same diameter over the entire vertical dimension of the rotor 21. In this way less tubulence is produced in the region of the discharge opening and thus a more even discharge is achieved. The principle decision as to which of the illustrated systems should be used, depends on the respective material to be processed.

Figure 17:
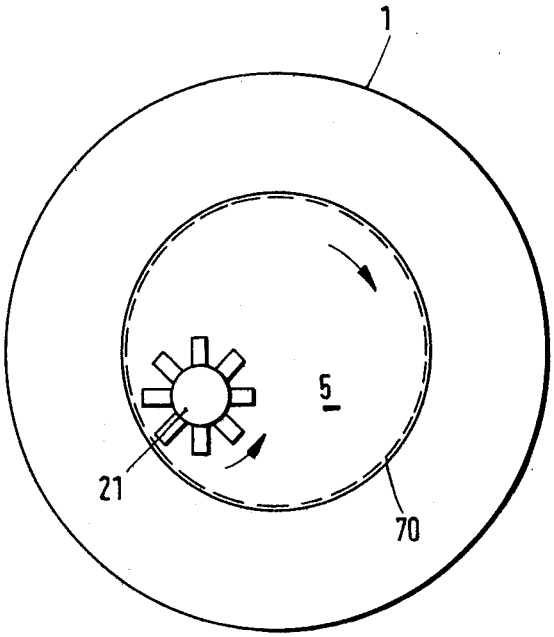
FIGS. 17 and 18 are a plan view and a cross-section of a truncated cone shaped drum with a straining wall incorporated therein.
Figure 18:
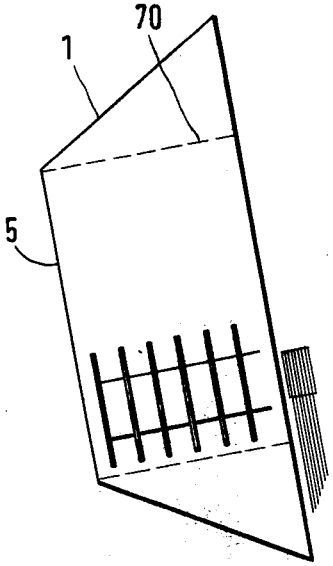

FIGS. 17 and 18 illustrates a further different embodiment also having a conical drum 1 and a rotor 21, which rotate in the opposite direction according to the arrows illustrated in FIG. 17. Here, a cylindrical straining wall 70 is incorporated. It is not necessary for this embodiment to surround the rotating drum 1 by means of a covering hood (as referred to in FIGS. 7 and 8 by reference numeral 42), which also acts as a collecting funnel. The conical part, i.e. the side wall 4 of the drum 1, itself acts as a collecting funnel here.

FIGS. 19*a* to 22*a* illustrate a diagrammatic lateral view of the drum 1, which has discharge openings 80 in the vicinity of its floor 5. These can be closed at least partially, preferably completely, by means of various embodiments.

In the embodiment according to FIGS. 19*a* and 19*b* there is illustrated a ring 82 laid coaxially around the drum 1 in its lower region and displaceable in the direction of the double arrow 81, which ring has the same number of openings 83 spaced at the same distances apart, which, by actuating a threaded spindle 84 and displacing them in the direction of arrow 81, either free the discharge openings 80 completely and thus open them or close them completely. In this embodiment the drum 1 is stopped so that the threaded spindle 84 provided for this purpose can be adjusted. The discharge of the material is effected in the lower region of the drum on which a fixed collecting apron (not illustrated in the Figures) is provided. In order to prevent the emergence of dust at the openings in the upper region a fixed covering is, for example, disposed over the rotating ring 82.

In the embodiments according to FIGS. 19 to 22, a discharge opening disposed in the lower region of the device is not necessary.

In the embodiment according to FIGS. 20*a* and 20*b* each discharge opening 80 can be closed with a cover 85. The cover 85 is mounted on one end of a double-armed lever 86, which is pivotable about an axis 87 and has a roller 88 at its other end. This roller slides in a U-shaped guide rail 89, which is pivotally mounted on the drum 1. Naturally, it is of annular shape to correspond with the periphery of drum floor 5. If this guide rail 89 displaced in the direction of the double arrow 90 then the lever 86 is forced to pivot about its axis 87 so that consequently the cover 85 is moved in the direction of the double arrow 91. This displacement of the guide rail 89 can if necessary also be effected during operation, whereby the discharge openings 80 are then correspondingly opened or closed.

The collars 100 provided in all FIGS. 19 to 22 enable the covers 85 to be deposited flatly so that complete closure is ensured.

In FIG. 20*b* it can be seen that all covers 85 are in an approximately half-open position corresponding to a certain position of the guide rail 89.

FIG. 21*a* illustrates a stationary U-shaped guide rail 101 in bent form. The double arrow 102 illustrates both that it is possible to secure the guide rail 101 so that it is completely off-set and that the roller 88 on the lever 86 is forced to move in the direction of the double arrow 102 when it rotates with the drum 1 over the pivot axis 87 mounted on said drum depending upon whether the roller is guided in the lower part or the upper part of the rail. The covers 85 are correspondingly removed in the lower parts and free the discharge opening 80, while closing the openings partially or completely in the upper region. It can therefore be seen from FIG. 21*b* that the covers 85 are wider open in the lower region than in the upper region. The cover disposed uppermost is closed in the illustration while the lowermost cover frees the discharge opening completely.

FIGS. 22*a* and 22*b* illustrate a very similar embodiment, wherein, however, the guide rail is designed as a curve template 103 which is composed of exchangeable pieces 104.

FIG. 22*a* also shows the prestressing of the levers 86 with the covers 85, which is so directed that the roller 88 always abuts with the curve template 103. This prestressing is effected in the embodiment of FIG. 22*a* in such a way that the pivot axis 87 is formed as a bar mounted in a guide tube 105. A torsion spring 106 is disposed in the guide tube 105 and holds the covers 85 in the closed position.

Figure 23:
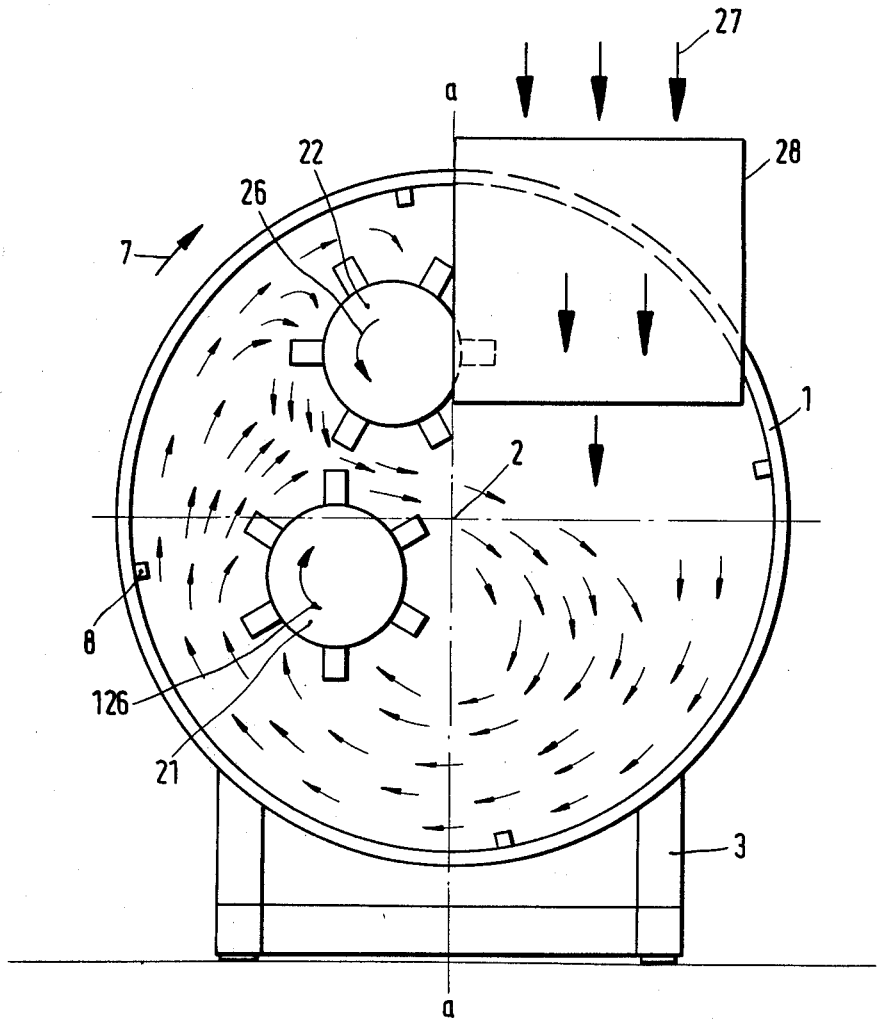

FIG. 23 shows a similar illustration to that of FIG. 1. The drum 1 is practically divided into two halves by the vertical dash-dotted central axis a—a; in the right-hand half the material flows substantially downwards in the direction of the indicated arrows. In the left-hand half the material ascends in the direction of rotation 7, partially entrained, for example, by the entrainment means 8. In this left-hand half of the drum 1 with its ascending direction of flow the two rotors 21 and 22 are disposed. They rotate in opposing directions corresponding to the arrows 26 and 126. In the upper right-hand quadrant of FIG. 23 the large space available for feeding is also shown, the material to be fed again being indicated by arrows 27.

It can be seen from this embodiment that for operation the rotor 21 rotates in the same direction as the drum 1. The crushing action of both rotors 21 and 22 is enormously increased by this because the discharge stream of the lower rotor 21 is substantially projected into the side rotating in the opposite direction by the upper rotor 22 so that in this region, which is illustrated by several arrows substantially directed in opposition to one another, extremely strong impact, pushing and shearing effects are produced. Naturally, this embodiment can only be used when the material to be processed is not presented in pieces that are two large or in bundles because otherwise there would be blockages between the drum wall and the rotor 21. In the case of material with smaller particles, however, this risk of blockage is minimal, especially since the rotor 21 rotates with a substantially higher peripheral speed in comparison with the drum 1. The material arriving from below is conveyed rapidly from the narrow region upwards. If the finest possible separation of the material is required, the upper rotor 22 is driven at a substantially higher peripheral speed than the lower rotor 21.

Figure 24A:
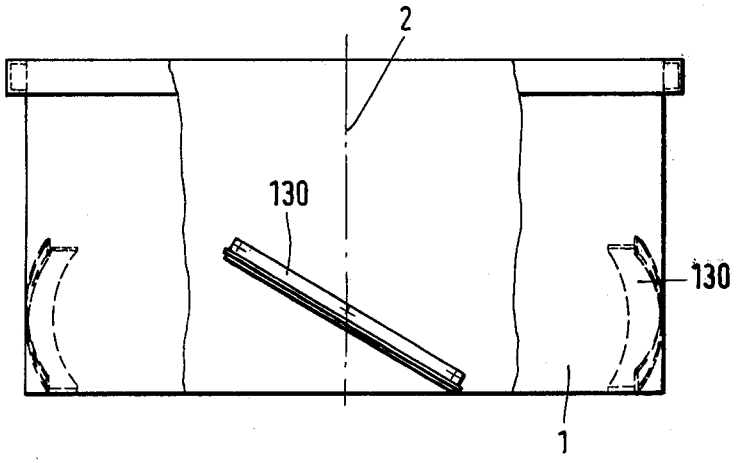
Figure 24B:
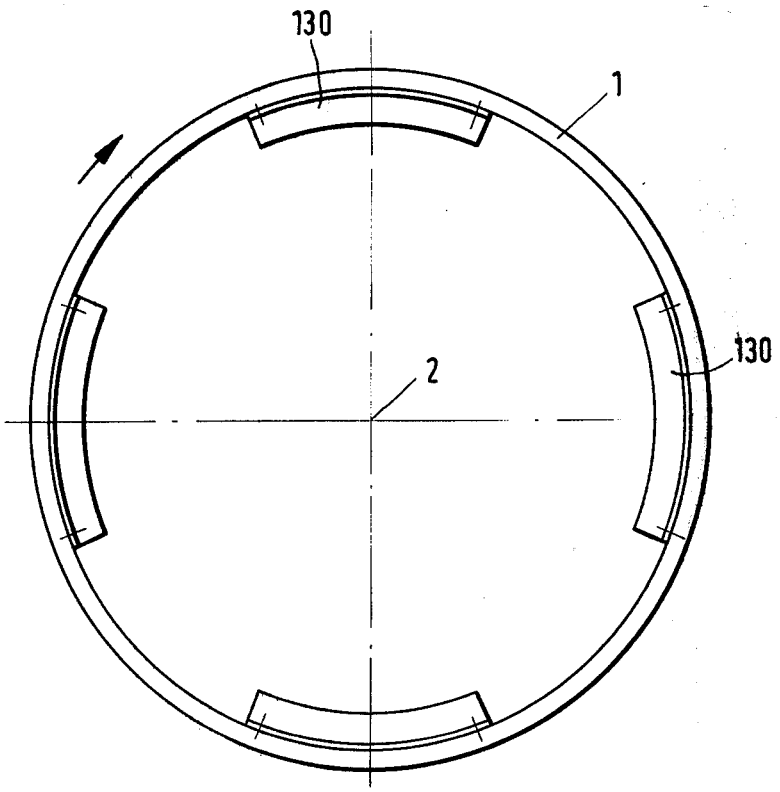

FIGS. 24*a* and 24*b* illustrate the entrainment means (130) inclined towards the pivot axis 2 of the drum 1, these means being mounted on the inner wall of the drum 1. The angle and the number of entrainment means 130 can be suited to the characteristics of the material to be processed. The entrainment means 130 ensure above all that no undesirable collection of material takes place at the lowest point of the drum. Since a certain distance must always be maintained between the rotors 21 and 22 and the drum floor 5 for reasons of safety, the inclined entrainment means 130 ensure that the material is almost totally guided to the active region of the rotor or rotors. In addition, in the case of high output capacities, the discharge of the crushed material is accelerated, particularly when inclined entrainment means 130 reach almost into the region of the discharge opening.

Experiment has shown that the action and direction of trajectory of the upper rotor 22 of the embodiment of FIG. 23 can be substantially increased. When the drum 1 rotated at a slow speed, the load on the lower rotor could be relatively high for example, while the load on the upper rotor was still low. As the rotational speed of the drum 1 increased, the load on the lower rotor diminished while the load on the upper rotor could be increased. Thus, it is possible to equalise the load on both rotors to a large extent by constructing the entrainment means 130 correspondingly and graduating the speed of rotation correctly.

We claim:

1. A preparation and crushing device, particularly for refuse materials, having a rotatably driven drum and at least one eccentrically disposed high-speed rotor, whose direction of rotation is opposite to that of the drum, characterised in that the drum (1) is driven at a subcritical rotational speed and is provided with a stationary hood (32) in which a feed means (28) is disposed, that a discharge opening (30) is provided in the lower region of the device in the form of a discharge flap (34) pivotally mounted on the stationary hood (32) and prestressed in the closing direction, which flap is inclined in the flow direction of the material (6) and that a plurality of splitting tools (25) are mounted on the at least one rotor (21, 22) along its rotational axis (23, 24), these tools being spaced apart axially from one another.

2. A device according to claim 1, characterised in that the pivot axis (2) of the drum (1) is disposed substantially horizontally.

3. A device according to claim 1, characterised in that the pivot axis (23, 24) of the rotor (21, 22) is disposed in the vicinity of the horizontal bisector (75) of the floor (5) of the drum (1).

4. A device according to claim 1, characterised in that entrainment means (8, 8′, 8″) are distributed over an inner wall (4) of the drum (1).

5. A device according to claim 4, characterised in that the entrainment means (8) are staggered vertically with respect to one another.

6. A device according to claim 4 or claim 5, characterised in that the entrainment means (8′, 8″) are of cam-shaped or tooth-shaped construction without acute angles.

7. A device according to claim 6, characterised in that the entrainment means (8′, 8″) are provided parallel to one another and spaced apart in the form of rings.

8. An apparatus according to claim 1 or claim 4, characterised in that the wall of the drum (1) is in the shape of a truncated cone.

9. A device according to claim 8, characterised in that the casing around the splitting tools (25) of the rotor (21, 22) is a truncated cone.

10. A device according to claim 1, characterised in that a straining wall (41, 70) is disposed at a distance from the drum wall (4).

11. A device according to claim 1, characterised in that deflectors (33) are provided in the region of the discharge flap (34).

12. A device according to claim 1, characterised in that entrainment means (130) are mounted on the inner wall of the drum (1) inclined towards the pivot axis (2) of said drum.

13. A device according to claim 1, characterised in that a plurality of closable discharge openings (80) are provided in the drum wall.

14. A device according to claim 13, characterised in that the discharge openings (80) can be closed by means of a ring with corresponding openings which can be displaced in the peripheral direction by means of plates (85) mounted on double-armed levers (86), wherein the end of the double-armed lever (86) opposite the plate (85) is provided with a roller (88) secured to a guide rail (89).

15. A device according to claim 14, characterised in that the guide rail (89) is constructed as a stationary curve template preferably composed of exchangeable pieces (104), the roller (88) on the double-armed lever (86) being prestressed to abut with said template.

16. A device according to claim 1, characterised in that there are two rotors (21, 22) which are driven in opposite directions of rotation and are provided in that half of the drum (1) in which the direction of flow is ascending.

17. A device according to claim 1 or 11, characterised in that the guide blades (38) are provided in the region of the discharge flap (34).

* * * * *